United States Patent [19]

Tsukimoto

[11] Patent Number: 5,022,434

[45] Date of Patent: Jun. 11, 1991

[54] DIRECTIONAL CONTROL VALVE

[75] Inventor: Toshiaki Tsukimoto, Zama, Japan

[73] Assignee: Toshiba Machine Co., Ltd., Tokyo, Japan

[21] Appl. No.: 469,187

[22] Filed: Jan. 24, 1990

[30] Foreign Application Priority Data

Jan. 27, 1989 [JP] Japan ..... 1-7659[U]

[51] Int. Cl.[5] ..... F15B 13/04

[52] U.S. Cl. ..... 137/596.2; 91/436; 137/596.13; 137/625.68

[58] Field of Search ..... 91/436; 137/596.13, 137/596.2, 625.68

[56] References Cited

U.S. PATENT DOCUMENTS

| | | | |
|---|---|---|---|
| 2,448,557 | 9/1949 | Stephens | 137/596.13 |
| 2,651,324 | 9/1953 | Hodgson et al. | 137/625.68 X |
| 2,916,050 | 12/1959 | Ruhl | 137/625.68 |
| 2,949,097 | 8/1960 | Vander Kaay | 137/625.68 |
| 2,980,136 | 4/1961 | Krehbiel | 91/436 |

*Primary Examiner*—Gerald A. Michalsky

*Attorney, Agent, or Firm*—Young & Thompson

[57] ABSTRACT

A directional control valve includes a casing having a bore therein, a pair of inlet/outlet passages connected to a pair of inlet/outlet apertures, a U-shaped supply passage disposed between the inlet/outlet passages, a pair of reservoir passages between which the inlet/outlet passages are disposed and a plunger which has a plurality of land portions and is reciprocably movable in the bore into which the inlet/outlet passages and the U-shaped passage and the reservoir passages open, such that a fluid passed through the inlet/outlet apertures and the inlet/outlet passages and the U-shaped supply passage and the reservoir passages is controlled in response to a reciprocating motion of the plunger. A sub-reservoir is provided, through which one of the inlet/outlet passages is communicated with one of the reservoir passages. The sub-reservoir has an inlet and an outlet which open into the bore so that both of the inlet and the outlet of the sub-reservoir are directed towards only one of the land portions or towards two of the land portions which are adjacent to each other.

1 Claim, 7 Drawing Sheets

DIRECTIONAL CONTROL VALVE

FIELD OF THE INVENTION

This invention relates to a directional control valve for controlling a drive mechanism and a direction of fluid flows in a construction equipment (specially a hydraulic shovel), particularly to the directional control valve with a regeneration function and an exhausted fluid reducing function.

BACKGROUND OF THE INVENTION

In general, as shown in FIG. 6, a hydraulic circuit for a hydraulic shovel is arranged such that pressurized fluid flows discharged from two hydraulic pumps 150 and 152 are respectively entered to combined control valves 154 and 156, each of which comprises directional control valves 158, 160, 162, 164, 166 and 168, so as to respectively operate corresponding actuators such as an arm cylinder 170, a swivel motor 172, a left-traveling motor 174, a right-traveling motor 176, a boom cylinder 178 and a bucket cylinder 180.

In the hydraulic circuit mentioned above, the arm cylinder 170, the boom cylinder 178 and the bucket cylinder 180 respectively suffer from some drawbacks due to vacuum being often generated by a downward overload which is imposed on the tensive side thereof, resulting in occurrence of cavitation in the flow passages. In order to overcome such a disadvantage, to the respective directional control valves 158, 166 and 168 for the cylinders 170, 178 and 180 are added regeneration functions whereby a pressure loss on the supply-side is compensated by bypassing fluid on the return-side to the supply-side (the hydraulic circuit of this type is hereinafter referred to as a regeneration path). More preferably, exhausted fluid reducing function is also added to the directional control valves so as to control a drop speed of the actuator when it is subjected to the downward overload.

The directional control valve with the aforementioned regeneration path and its exhausted fluid reducing function are hereinafter described. For example, Japanese Patent Publications Nos. 46-15059 and 41-10446 disclose the directional control valve of this type.

Namely, FIG. 4(*a*) shows the directional control valve according to the Japanese Patent Publication No. 46-15059.

Referring to FIG. 4(*a*) a plunger 50 inserted into a plunger bore 52 of a housing is reciprocated from a neutral position to left and right positions in the bore so that a cylinder can operate to start and stop a vertical motion of an actuator cylinder on which a downward load is imposed.

Chambers 54, 56, 58, 60, 62, 64 and 66 are located in a sequentially spaced from the right to the left in the axial direction of the plunger 50. The chambers 56 and 64 are respectively connected to chambers 70*a* and 70*b* of a cylinder 70 while the chambers 54 and 66 are respectively connected to reservoirs 68.

Further, a pair of annular peripheral grooves 72 and 73 are provided at the center of the plunger 50 and isolated from each other by a plunger land 28. Plunger lands 79 and 80 are also formed on both end portions of the plunger.

Accordingly, when the plunger 50 is in the neutral position, the plunger lands 79 and 80 isolate, from the other chambers, the chambers 56 and 64 communicating with the chambers 70*a* and 70*b* of the cylinder 70, respectively.

An axial inner bore of the plunger 50 receives a pair of poppet valves comprising a check valve 112 and a control valve 114, a bypass valve 98 and a check valve 92 for preventing a load-drop . These valves have a restoring force due to elasticity of springs being used together with the valves.

As shown in FIG. 4(*a*), when the plunger 50 moves to the right position, fluid in a rod side chamber 70*b* of the cylinder enters into a bore 84 in front of a head of the bypass valve 98 arranged in the center portion of the axial inner bore of the plunger 50. Then, the bypass valve 98 is opened due to increase in pressure developed by the entering fluid so that a portion of the fluid flows into a supply passage 99.

The supply passage 99 is communicated through a fluid passage 88 formed on the plunger side wall, with a bore 82 formed on the head side of the check valve 92 which is arranged on the left side of the axial inner bore of the plunger 50. When the pressure force developed by the fluid entering from the supply passage 99 opens the check valve 92, the fluid is passed through a passage 90 formed on the side wall of the plunger 50 to communicate with the cylinder head side chamber 70*a*.

In operation, when the plunger 50 is in the illustrated position, fluid exhausted from a pump 128 is supplied to the head side chamber 70*a* of the cylinder 70 through the chamber 62, the fluid passage 88, the check valve 92, the passage 90 and the chamber 64. In this case, a portion of fluid in the cylinder rod side chamber 70*b* is supplied to the inside bore 84 of the bypass valve 98 through a fluid passage 106 and the rest is transmitted to a bore 104 through a passage 94.

Then, pressure force developed by the fluid is exerted on the head of a check valve 112 so as to open the check valve 112. Since a passage 108 formed on the housing side wall facing the plunger bore 52 is closed, the pressure force acts on a control valve 114 so as to move it to the open position. However, the check valve 112 and the control valve 114 can not be opened unless the pressure force exceeds a restoring force of a spring 122.

When the control valve 114 is opened, the check valve 112 in closing position is cracked to be opened. As a result, a return flow passing through the passage 94 into the bore 104 flows into the reservoir 68 through the check valve 112, the control valve 114, the passage 110 and the chamber 54.

Meanwhile, in the case an excess load acts on the cylinder so as to contract the rod side chamber 70*b* thereof, a piston 71 tends to be lowered at higher speed exceeding a capacity of the pump 128 by which the fluid is filled in a cavity of the cylinder head side chamber 70*a*, so that the feeding pressure of the pump is spontaneously decreased. In this case, a back pressure developed in a return path through which the return flow passes is exerted on the valve head 120 of the check valve 112. The back pressure is also exerted on the bypass valve 98 and serves to release the bypass valve 98 from a valve seat face so that a regeneration path can be opened.

To this end, a part of the return flow is transmitted to the supply passage 99 through the passage 94, the bore 84, the bypass valve 98, the passage 96, the annular peripheral groove 72 and the chamber 58. The fluid passing through such a flow path can compensate a short flow pumped from the pump 128 and be filled in the head side chamber 70*a* of the cylinder 70.

FIG. 4(*b*) shows the directional control valve according to the Japanese Patent Publication No. 41-10446.

Slidably inserted into a bore of the valve body 51 is a plunger 119 which can reciprocate from a neutral position to two opposite positions thereto. When the plunger 119 is moved to either one position, either one of central passages 67 and 69 is closed so that fluid pumped from a pump 65 is transmitted to either one of intake passages 74 and 76 through a supply passage 75 and a V-shaped connection passage 81.

The intake passages 74 and 76 are respectively connected to chambers 70*a* and 70*b* of the cylinder 70 through connection ports 55 and 57.

End portions of the V-shaped connection passage 81 are respectively communicated with a pair of peripheral grooves 83 and 91 formed outside the central passages 67 and 69 which are intersectionally communicated with a central portion of the bore in the valve body 51. The V-shaped connection passage 81 is communicated with the supply passage 75 through a back pressure check valve 85.

A pair of another peripheral grooves 86 and 87 are formed outside the peripheral grooves 83 and 91 in the longitudinal direction of the plunger 119 and communicate with the intake passages 74 and 76.

On the other hand, an exhaust passage 103 communicating with a reservoir 68 is formed in the central portion of the valve body 51 and communicated with a U-shaped return passage 89 extending through a relief valve 130 in two opposite directions. End portions 93 and 95 of the U-shaped return passage 89 respectively are formed on the positions outside and adjacent to the peripheral grooves 86 and 87 in the longitudinal direction of the plunger 119 and intersect the bore in which the plunger 119 is reciprocated.

In this case, the exhaust passage 103 and the U-shaped return passage 89 communicate with each other through the relief valve 130.

Further, the end portions 93 and 95 of the U-shaped return passage 89 are respectively communicated through the bore in the valve body with extensions 101 and 102 extending in parallel with the intake passages 74 and 76 which are respectively connected to the connection ports 55 and 57.

The extensions 101 and 102 are respectively communicated with the intake passage 74 and 76 through bypasses 97 and 100 and cavity control valves 105 and 107 having the same structure as the relief valve 130.

Accordingly, in the case fluid pressure in either of the intake passages 74 and 76 decreases less than that in the U-shaped return passage 89, for example, when cavitation tends to occur in the intake passage 74 or 76, pressure force developed by high pressure fluid in the U-shaped return passage 89 is exerted on the annular shoulder portion of either one of the cavity control poppet valves 105 and 107 communicating with the intake passages 74 and 76, respectively. Then, one of the poppet valves is separated from a valve seat so that return fluid is transmitted through the opened bypass 97 or 100 to the intake passage 74 or 76. To this end, the respective poppet valves are controlled such that a constant pressure difference can be maintained between the intake passages 74 and 76 and the U-shaped return passage 89. Under this operating condition, the poppet valve is separated further from the valve seat in case of reduction of the pressure in the intake passage 74 or 76. Thus, there is provided the directional control valve with a regeneration path.

FIGS. 5(*a*) and 5(*b*) show a directional control valve with exhausted fluid throttling function.

Referring to FIG. 5(*a*), in order to control gravitational drop speed when a load "W" is vertically imposed on a cylinder rod, the directional control valve 132 is provided with an exhausted fluid throttling device 133 with a check valve, which can reduce the fluid to be exhausted from the head side chamber 70*a* of the cylinder 70.

Referring to FIG. 5(*b*), a metering notch 135, a volume of which varies as the plunger moves in the axial direction, is formed on a plunger groove end 134. Exhausted fluid in the head side chamber 70*a* of the cylinder 70 can be throttled by contracting the volume of the metering notch in the vicinity of a piston stroke end when moving the plunger.

However, in recent years an operating pressure of the hydraulic equipment has been extremely increased. In the conventional directional control valve with the regeneration path shown in FIG. 4(*a*), the plunger is provided with a plurality of poppet valves. Therefore, a strength of the plunger may be reduced when efficiently forming a plurality of the passages in the plunger bore. Otherwise, even though the strength of the plunger is increased, the passages cannot be efficiently arranged and the manufacturing structure of the plunger may become complicated.

Although there has been proposed many other directional control valves having the plunger equipped with poppet valves therein, neither of the valves can overcome such problems as mentioned above.

In another type of a conventional directional control valve shown in FIG. 4(*b*), the above problems associated with the valve shown in FIG. 4(*a*) are eliminated. However, when the plunger is in the neutral position, the cavity control valve can not be operated due to the check valve arranged between the V-shaped connection passage and a main reservoir.

On the other hand, a conventional directional control valve with an exhausted fluid throttling function shown in FIG. 5(*a*), is provided in the outside position of the housing, with an exhausted fluid throttling device including a check valve. Some space is required to install the directional control valve. Further, since the check valve should be manufactured larger in order to form passages for a fluid flow, the exhausted fluid throttling device tends to be manufactured in larger size as a whole.

Referring to FIG. 5(*b*) another conventional directional control valve includes the plunger with the metering notch so as to throttle the exhausted fluid by changing the volume of the metering notch as moving the plunger. The directional control valve can effect space-saving and lower cost. However, a variety of the plunger should be employed according to gravitational drop speed of actuators to be used and should be manufactured on the basis of configuration of the metering notch.

SUMMARY OF THE INVENTION

Accordingly, it is an object of the present invention to provide a directional control valve having the sufficient strength of the plunger while forming the regeneration path, performing the same function as a negative pressure preventing valve and the exhausted fluid throttling function by replacement of the minimum parts and comprising controlling parts for controlling the volume of the metering notch.

In accordance with the present invention, there is provided a directional control valve in combination of a casing containing a bore, a pair of inlet/outlet passages, a U-shaped supply passage formed between the inlet/-outlet passages, a pair of reservoir passages formed outside the respective inlet/outlet passages, a plunger being reciprocatable in the bore and being capable of opening and closing the respective passages, so that fluid can be supplied and exhausted from inlet/outlet apertures connected to the inlet/outlet passages according to a motion of the plunger.

The directional control valve according to the invention is also provided with a sub-reservoir between one of a pair of the inlet/outlet passages and one of the reservoir passages such that exhausted fluid can be transmitted from the sub-reservoir to the other passage of the inlet/outlet passages when moving the plunger from the inlet/outlet aperture side to the outlet aperture side.

In such a case, a valve body communicating with the sub-reservoir may be provided in the vicinity of the plunger. The valve body is provided on one end thereof with a back pressure valve communicating with a reservoir and provided on the other end with a check valve which operates so as to transmit the exhausted fluid from the sub-reservoir to the other passage of the inlet/-outlet passages when moving the plunger from the inlet/outlet aperture side to the outlet aperture side.

It is preferable to provide the sub-reservoir between one of a pair of the inlet/outlet passages and one of the reservoir passages, a check valve on one end of a plunger bore and a back pressure valve on the sub-reservoir, which is communicated with the reservoir. To this end, a portion of the exhausted fluid can be transmitted from the sub-reservoir through the back pressure valve to the other passage of the inlet/outlet passages when moving the plunger from the inlet/outlet aperture side to the outlet aperture side.

Further, a throttle valve communicating with the reservoir may be arranged on the sub-reservoir which is provided between one of a pair of inlet/outlet passages and one of the reservoir passages.

The directional control valve according to the present invention comprises a sub-reservoir provided between one of a pair of inlet/outlet passages and one of a pair of reservoir passages. When the plunger is moved from the inlet/outlet aperture side to the outlet aperture side, the fluid is transmitted from the inlet/outlet passage to the sub-reservoir. In such a case, a drop speed of a load is determined by its weight upon the drop operation of the load. In the case an amount of the fluid in a head side chamber of a hydraulic cylinder is decreased, i.e., negative pressure occurs in the head side chamber of the hydraulic cylinder, the fluid transmitted from the inlet/outlet port enters into the sub-reservoir. Then, a check valve is opened so that a short flow of the fluid is compensated by supplying the fluid on the outlet side from the sub-reservoir through a supply passage and the other inlet/outlet passage to the head side chamber of the hydraulic cylinder. On the other hand, when the fluid is sufficiently supplied to the head side chamber and pressure in the supply passage exceeds a predetermined pressure for the back pressure valve, the check valve is closed so that the fluid in the sub-reservoir is transmitted through the back pressure valve to the reservoir passage.

As a result, a regeneration function and the exhausted fluid throttling function can be performed.

BRIEF DESCRIPTION OF THE DRAWINGS

Preferred embodiments of the present invention will be described hereinafter in detail with reference to the accompanying drawings in which:

As a matter of explanatory convenience, like reference numerals refer to like parts without a detailed explanation for the respective parts in a conventional directional control valve in FIGS. 4 and 5.

FIG. 4(*b*) is a sectional view of a conventional directional control valve with a regeneration path according to Japanese Patent Publication No. 41-10446.

FIG. 5(*b*) is a partial diagram of a plunger having a metering notch which is used for a conventional directional control valve with an exhausted fluid throttling function.

PREFERRED EMBODIMENTS OF THE INVENTION

Figure 1:
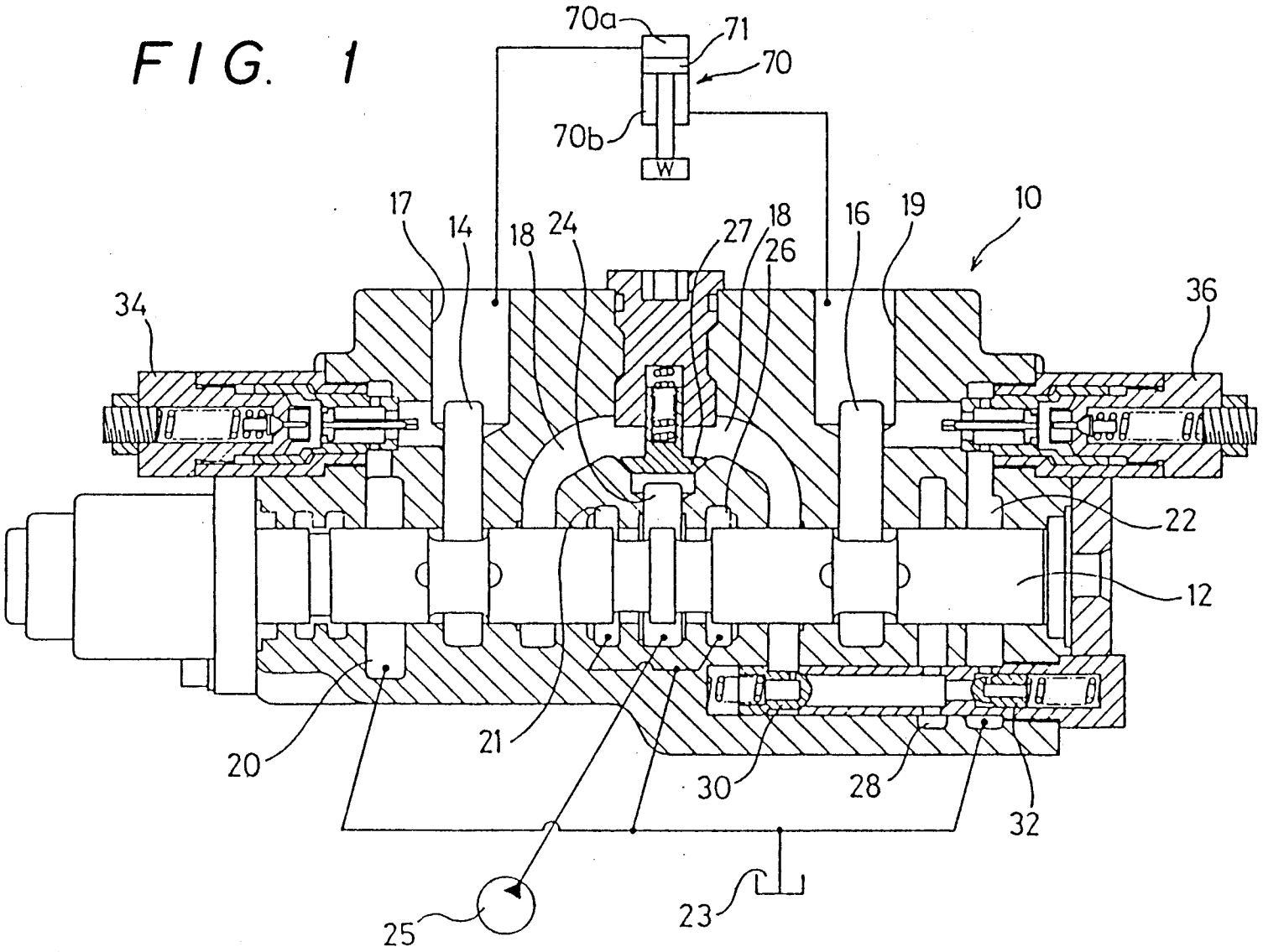
FIG. 1 is a sectional view of a directional control valve according to a first embodiment of the present invention.

Referring now to FIG. 1, a plunger 12 is slidably inserted into a bore of a casing 10. In the casing 10, there are formed a pair of inlet/outlet passages 14 and 16, inlet/outlet apertures 17 and 19 connected to the inlet/-outlet passages, an inverted U-shaped supply passage 18 arranged between the inlet/outlet passages, and reservoir passages 20 and 22 respectively arranged on the outside of the inlet/outlet passages and connected to a reservoir 23. A primary bypass passage 24 is connected through a check valve 27 to a central portion of the U-shaped supply passage 18 and communicates with a pump 25. A pair of secondary bypass passages 21 and 26 are respectively arranged between the U-shaped supply passage 18 and the bypass passage 24 and communicates with a reservoir 23.

In such passages-formation, fluid pumped from the pump 25 is circulated to the reservoir 23 when the plunger 12 is placed in a neutral position. On the other hand, when the plunger 12 is moved to the operating positions, the fluid is delivered to the U-shaped supply passage 18 through the bypass passage 24 and the check valve 27.

Further, a sub-reservoir 28 provided between the inlet/outlet aperture 19 and the reservoir passage 22 is connected on one side through a check valve 30 to the U-shaped supply passage 18 and on the other side through a back pressure valve 32 to the reservoir passage 22. Generally known actuator protecting members 34 and 36, each of which is formed by integrating an overload relief valve and a negative pressure preventing valve, are respectively arranged between the inlet/outlet passages 14 and 16 and the reservoir passages 20 and 22. Each of the inlet/outlet apertures 17 and 19 is connected to a hydraulic cylinder 70 so as to raise or lower a load "W" by transmitting a fluid pressure to the cylinder.

The directional control valve having the above-mentioned structure operates as follows:

Namely, in FIG. 1, when the load "W" is lowered by moving the plunger 12 to the right, the speed of a descent of the load "W" is determined by its weight. Accordingly, the amount of fluid entering the head side chamber 70*a* of the hydraulic cylinder 70 may in some cases be insufficient even though all the fluid pumped by the pump 25 is delivered to the head side chamber.

In this case, a regeneration path according to this invention is operated such that the shortage of the fluid amount in the head-side chamber can be compensated by transmitting the fluid, which is exhausted from a rod side chamber 70*b*, through the inlet/outlet aperture 19 and the sub-reservoir 28 to the reservoir 23.

As described above, in case the head side chamber 70*a* of the hydraulic cylinder 70 is caused to have a negative pressure, the check valve 30 is opened so that the shortage of the fluid is compensated by supplying the fluid from the sub-reservoir 28 through the U-shaped supply passage 18 and the inlet/outlet passage 14 to the head side chamber 70*a* of the hydraulic cylinder 70. When the fluid amount supplied is sufficient and pressure in the U-shaped supply passage 18 exceeds a predetermined pressure in the back pressure valve 32, the check valve 30 is closed so that the fluid in the sub-reservoir 28 is transmitted through the back pressure valve 32 to the reservoir passage 22.

Even though either chamber in the hydraulic cylinder has a negative pressure due to any reason when the plunger 12 is placed in a neutral position, negative pressure preventing valves included in the actuator protecting members 34 and 36 can eliminate the negative pressure.

Figure 2:
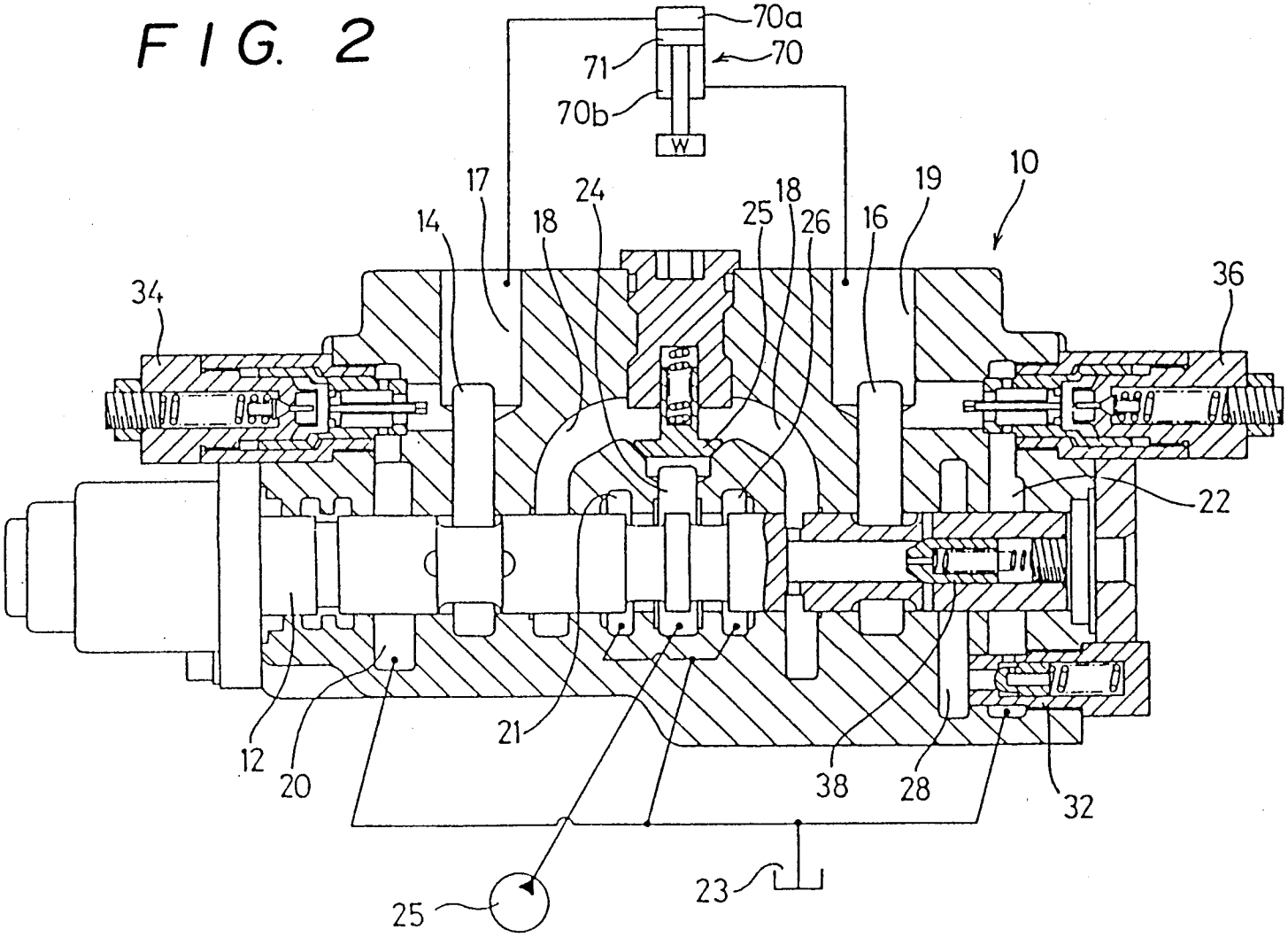
FIG. 2 is a sectional view of a directional control valve according to a second embodiment of the present invention.

FIG. 2 is a sectional view of the directional control valve according to second embodiment, which comprises a check valve 38 in the plunger.

In this case, the directional control valve can perform a regeneration check function without a combination of multiple check valves so as to obtain enough passage-forming area and sufficient strength of the plunger.

Figure 3:
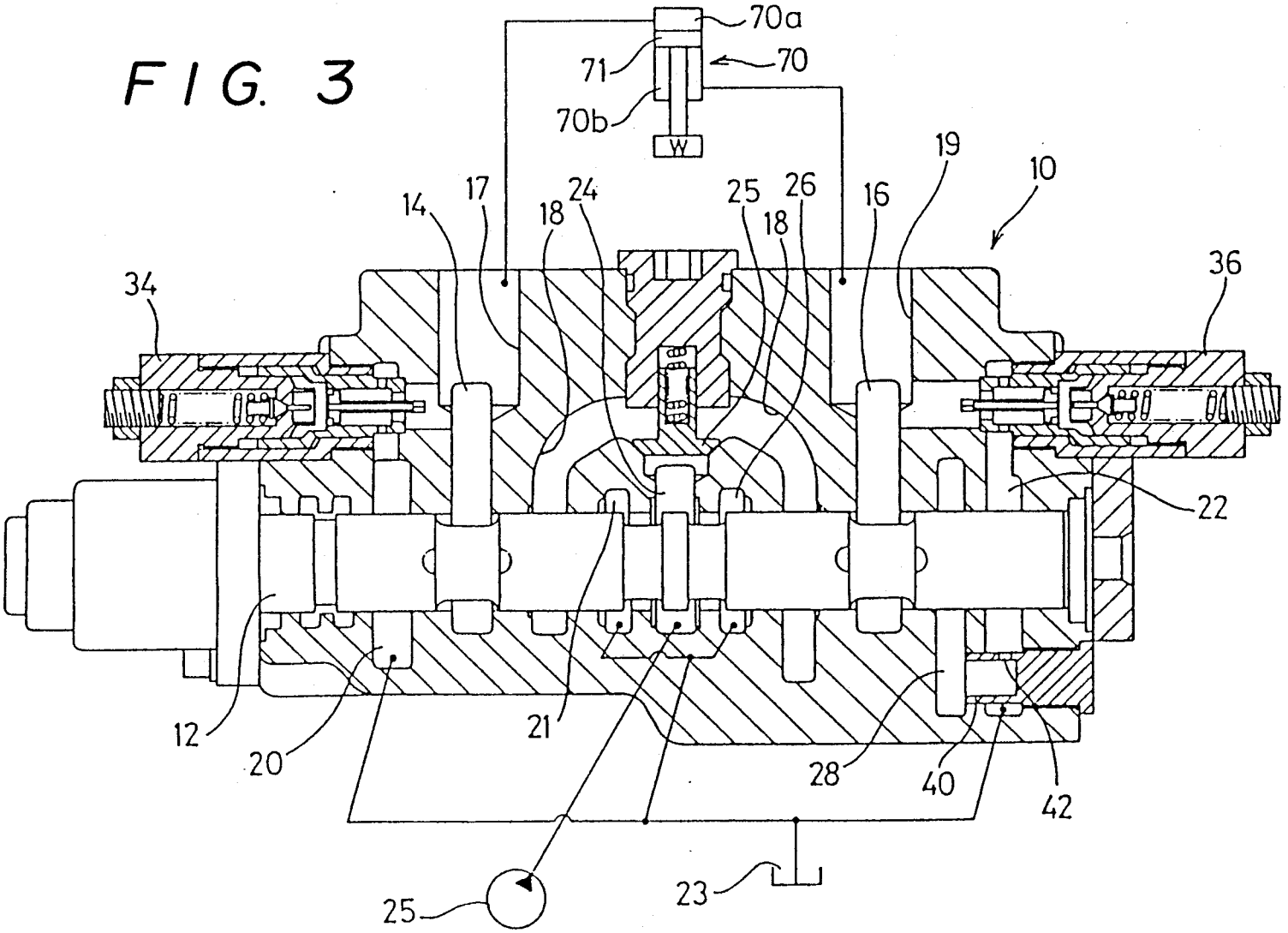
FIG. 3 is a sectional view of a directional control valve according to a third embodiment of the present invention.
Figure 4:
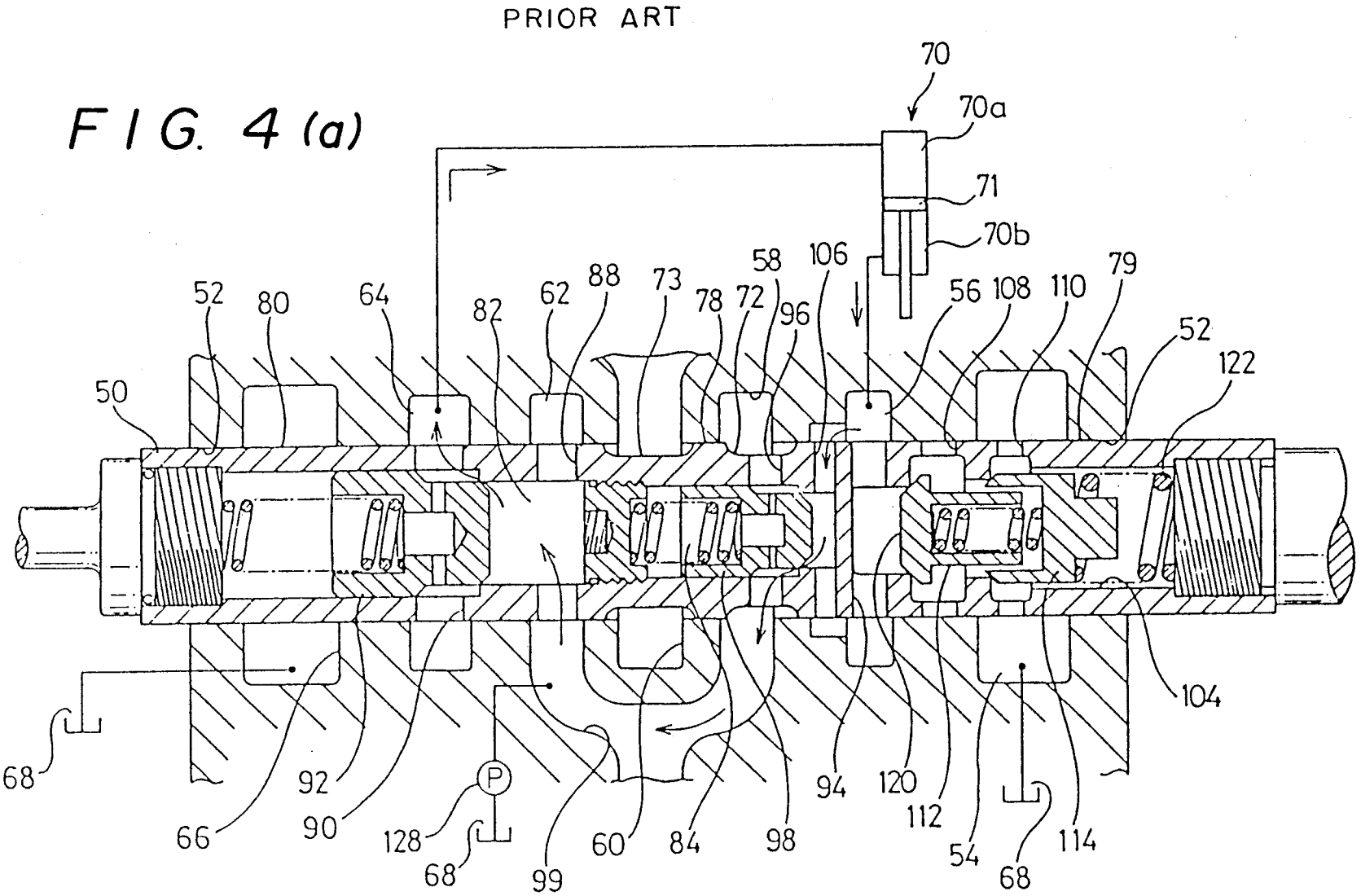
PRIOR ART FIG. 4 (a)
FIG. 4(*a*) is a sectional view of a conventional directional control valve with a regeneration path according to Japanese Patent Publication No. 46-15059.
Figure 4:
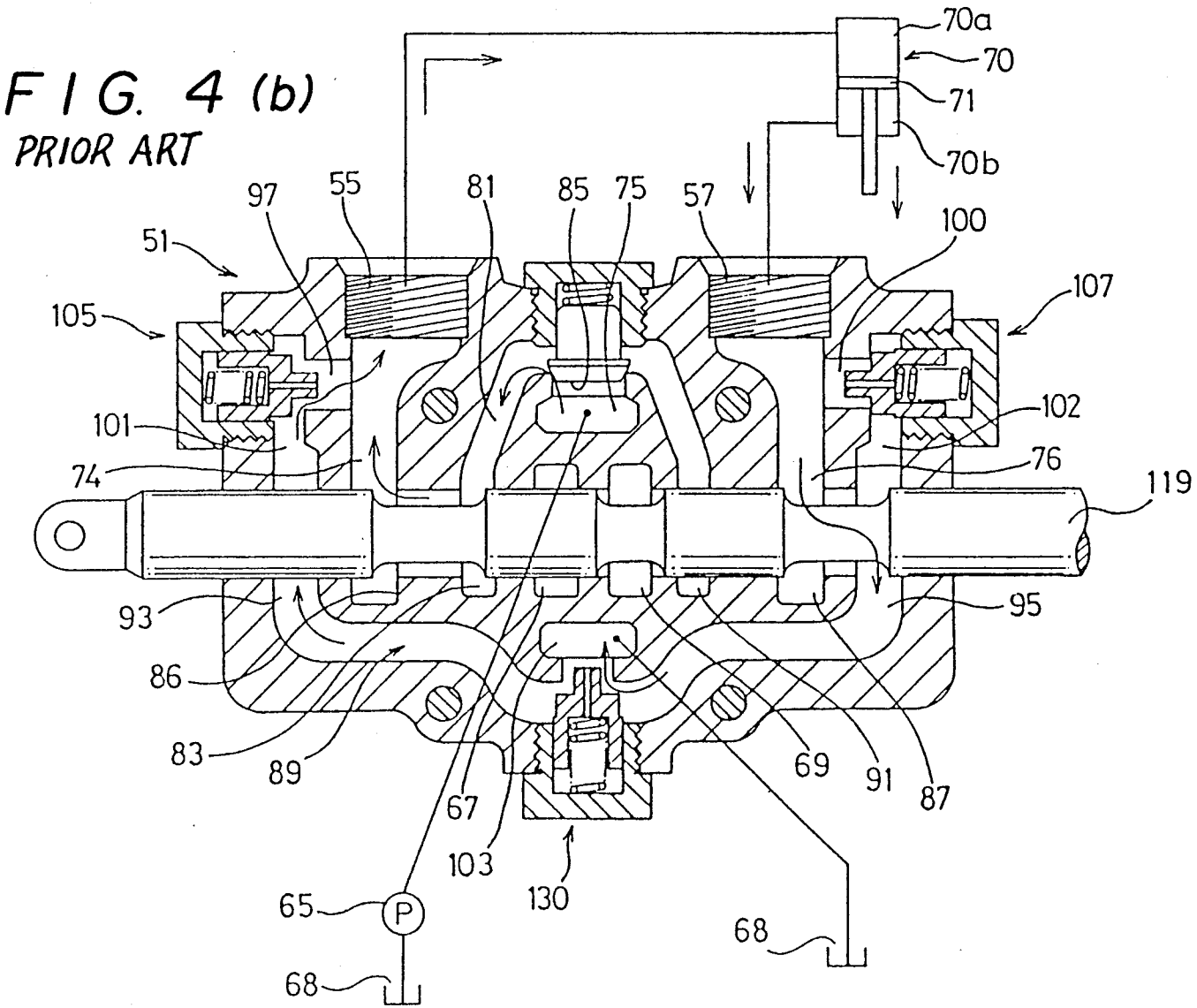
FIG. 4 (b) PRIOR ART
Figure 5:
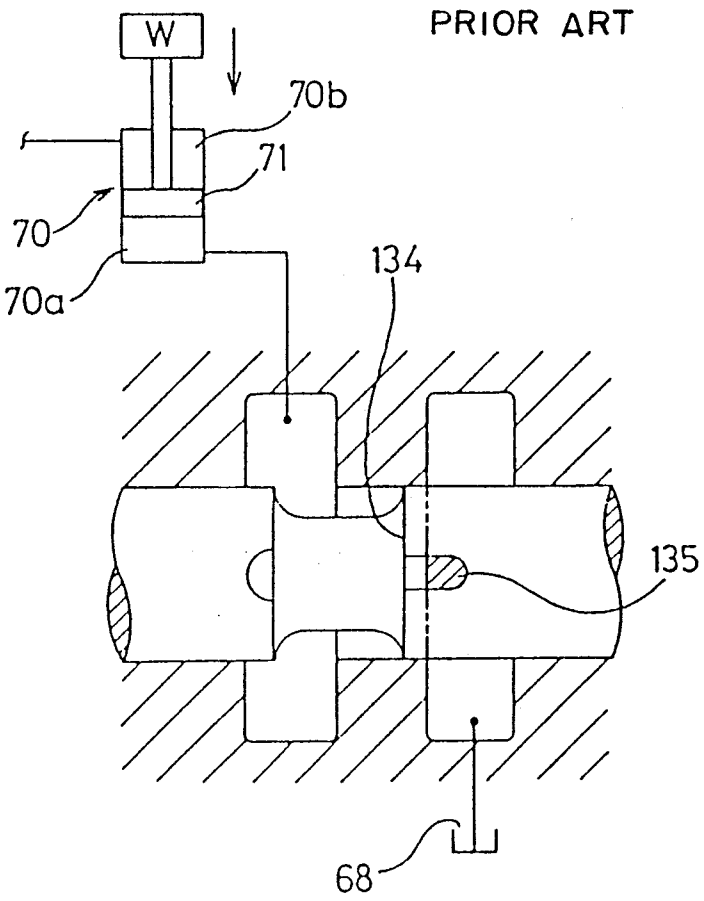
FIG. 5 (b) PRIOR ART
FIG. 5(*a*) is a diagram of a hydraulic circuit for a conventional directional control valve which is provided with an exhausted fluid throttling device containing a check valve, in the outside position of a housing so as to perform an exhausted fluid throttling function.
Figure 5:
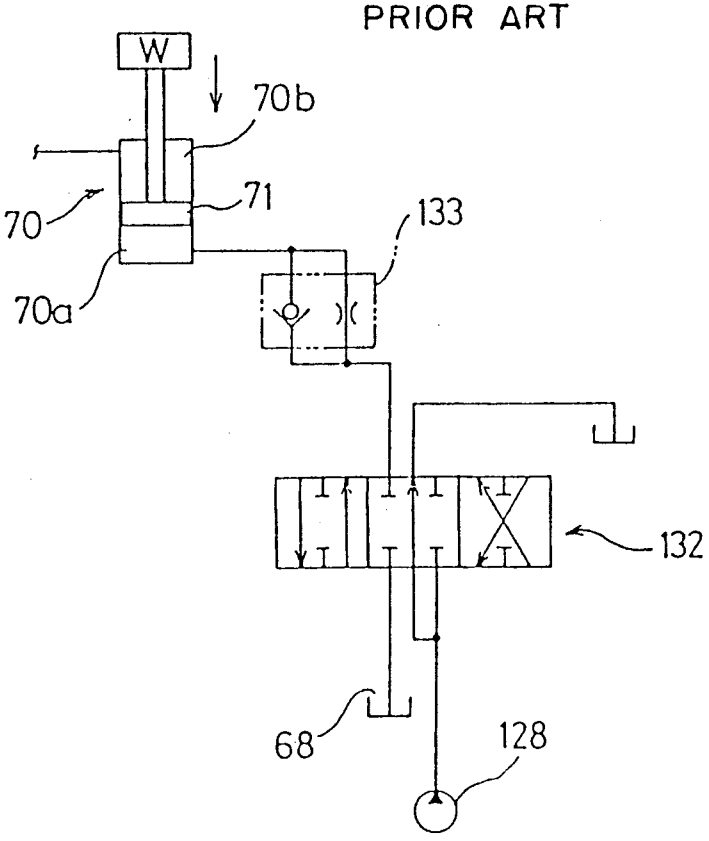
FIG. 5 (a) PRIOR ART
Figure 6:
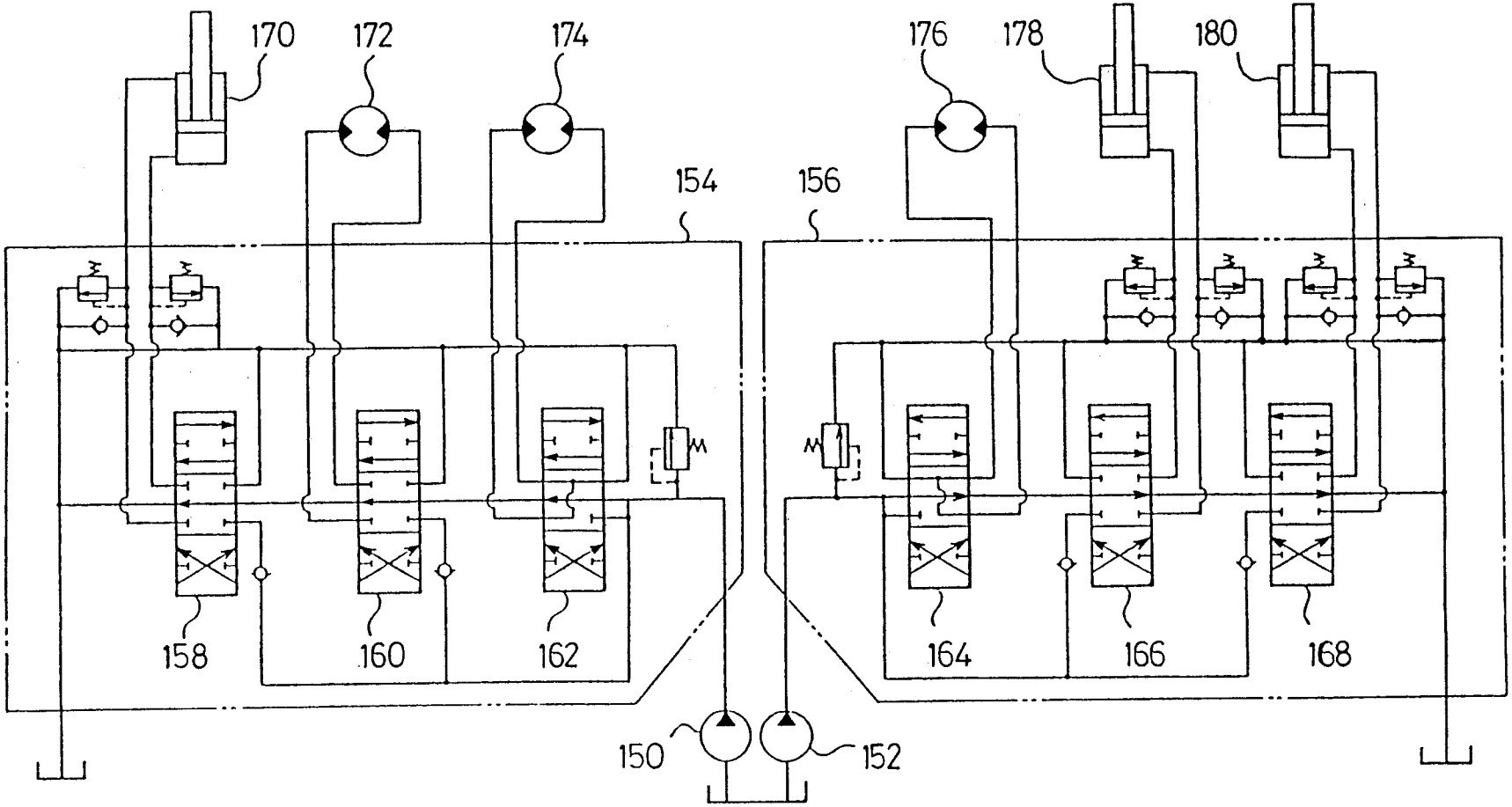
FIG. 6 is a diagram of a hydraulic circuit for a hydraulic shovel.

Further, as shown in FIG. 3, a throttle valve 40 is screwed between a sub-reservoir 28 and a reservoir passage 22 in the casing 10 in order to reduce the speed as descent of a piston which is determined by a load "W". The speed of descent can be changed by replacing the throttle valve to be used as the minimum part. The throttle valve is capable of being easily controlled by any means, for example, the plunger of a spring-float type may be provided in the throttle valve so that area of an aperture 42 can be controlled by a backward/forward motion of the plunger caused by a revolving motion of the throttle valve.

As described in the above embodiments, in case of forming the regeneration path, a back pressure is generated in the sub-reservoir 28 by using the back pressure valve 32. However, any other means such as a throttle valve or a controllable throttle valve, etc. may be employed instead of the back pressure valve.

As is obvious from the aforementioned embodiments, according to the invention, there is provided a directional control valve in combination with a casing containing a bore, a pair of inlet/outlet passages, a supply passage formed between the inlet/outlet passages, a pair of reservoir passages formed on the outside of the respective inlet/outlet passages and a reciprocable plunger capable of opening and closing the respective passages, such that fluid is supplied and exhausted from inlet/outlet apertures connected to the inlet/outlet passages according to a movement of the plunger. The directional control valve is also provided with a sub-reservoir between one of a pair of the inlet/outlet passages and one of the reservoir passages such that exhausted fluid is transmitted from the sub-reservoir to the inlet/outlet passage when moving the plunger from the inlet/outlet aperture side to the outlet aperture side. To this end, the sufficient strength of the plunger and enough space for the passages to be formed in the plunger can be obtained. In addition, the regeneration path is formed without eliminating the function of a negative pressure preventing valve in case of placing the plunger in the neutral position. Further, the minimum number of parts can perform exhaust fluid throttling functions, resulting in a simple inner structure of the plunger and the casing, etc. Therefore, parts manufacture and assembly adjustment are facilitated so that manufacturing cost can be efficiently reduced.

Although the sub-reservoir which forms an important part of the present invention is provided on the outside of one of inlet/outlet passages in the aforementioned preferred embodiments, two sub-reservoirs may be arranged on the outside of both inlet/outlet passages. In addition, if the load is carried at an upper position of the cylinder so as to be lifted up thereby, each sub-reservoir in the preferred embodiments can be operated effectively. Thus, it will be appreciated that many structural variations and modifications in the directional control valve may be made without departing from the spirit and scope of the invention.

What is claimed is:

1. In a directional control valve including a casing having a bore therein, a pair of inlet/outlet passages connected to a pair of inlet/outlet apertures, a U-shaped supply passage disposed between said inlet/outlet passages, a pair of reservoir passages between which said inlet/outlet passages are disposed and a plunger which has a plurality of land portions separated by grooves which in at least one position of said plunger establish communication between said passages, said plunger being reciprocally movable in said bore into which said inlet/outlet passages, said U-shaped passage and said reservoir passages open, such that a fluid passed through said inlet/outlet apertures, said inlet/output passages, said U-shaped supply passage and said reservoir passages is controlled in response to a reciprocating motion of said plunger;

the improvement which comprises a sub-reservoir external to the plunger through which one of said inlet/outlet passages communicates with one of said reservoir passages, said sub-reservoir being provided with an inlet which opens into said bore and an outlet, said sub-reservoir communicating with only one of said land portions in a neutral position of said plunger, and one-way valve means through which said outlet of the sub-reservoir communicates with said one of said reservoir passages and one of said inlet/outlet passages, said one-way valve means being used for controlling the fluid transmitted from said sub-reservoir from said one of said inlet/outlet passages communicating with said sub-reservoir when said plunger is moved longitudinally toward one of said inlet/outlet apertures used as an outlet aperture.

* * * * *